US011691426B2

(12) United States Patent
Stefani

(10) Patent No.: US 11,691,426 B2
(45) Date of Patent: Jul. 4, 2023

(54) MANAGEMENT SYSTEM FOR THE INK IN A PRINTING MACHINE

(71) Applicant: SYSTEM CERAMICS S.P.A., Fiorano Modenese (IT)

(72) Inventor: Franco Stefani, Sassuolo (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 304 days.

(21) Appl. No.: 17/277,021

(22) PCT Filed: Sep. 5, 2019

(86) PCT No.: PCT/IB2019/057475

§ 371 (c)(1),
(2) Date: Mar. 17, 2021

(87) PCT Pub. No.: WO2020/058793

PCT Pub. Date: Mar. 26, 2020

(65) Prior Publication Data

US 2022/0032635 A1 Feb. 3, 2022

(30) Foreign Application Priority Data

Sep. 21, 2018 (IT) ..... 102018000008812

(51) Int. Cl.
*B41J 2/175* (2006.01)

(52) U.S. Cl.
CPC ..... *B41J 2/17523* (2013.01)

(58) Field of Classification Search
CPC .... B41J 2/175; B41J 2/17506; B41J 2/17509; B41J 2/17513; B41J 2/1752; B41J 2/17523; B41J 2/17553; B41J 29/13
See application file for complete search history.

(56) References Cited

U.S. PATENT DOCUMENTS 5,631,681 A 5/1997 Klaus
5,745,137 A 4/1998 Scheffelin
(Continued)

FOREIGN PATENT DOCUMENTS

CN 102555500 A 7/2012
CN 203221741 U 10/2013
(Continued)

OTHER PUBLICATIONS

Chinese Office Action from Chinese Patent Application No. 201980061180.5, dated Mar. 3, 2022, 8 pages.
(Continued)

*Primary Examiner* — Anh T Vo

(74) *Attorney, Agent, or Firm* — Pearne & Gordon LLP; J. Gregory Chrisman

(57) ABSTRACT

Management system for the ink in a printing machine, comprising: one or more tanks (2), each of which is equipped with hydraulic connections (21) for quick coupling and an inner layer of insulation; a docking station (3), arranged to be placed in a printing machine, which comprises hydraulic connections (31) for quick coupling, intended to be connected to the hydraulic connections (21) of one or more tanks (2); motor means (4), associated with the docking station (3) and arranged to transfer a tank (2) between a standby position and an operating position within the docking station, and to produce the coupling of the hydraulic connections (21,31).

9 Claims, 6 Drawing Sheets

(56) References Cited

U.S. PATENT DOCUMENTS

| | | | | |
|---|---|---|---|---|
| 5,777,646 | A * | 7/1998 | Barinaga | B41J 2/1755 347/86 |
| 5,828,389 | A | 10/1998 | Yamaguchi | |
| 5,972,111 | A | 10/1999 | Anderson | |
| 6,076,920 | A | 6/2000 | Zapada et al. | |
| 6,089,160 | A | 7/2000 | Anderson | |
| 6,239,822 | B1 | 5/2001 | Zapata et al. | |
| 6,319,555 | B1 | 11/2001 | Anderson | |
| 6,398,869 | B1 | 6/2002 | Anderson | |
| 6,629,758 | B2 * | 10/2003 | Okamoto | B41J 2/17596 347/85 |
| 8,136,931 | B2 * | 3/2012 | Miyazawa | B41J 2/17596 347/85 |
| 8,770,732 | B2 | 7/2014 | Jones | |
| 11,109,729 | B2 | 9/2021 | Juettner | |
| 2003/0076390 | A1 * | 4/2003 | Sturgeon | B41J 2/1752 347/86 |
| 2004/0089174 | A1 | 5/2004 | Ghisalberti | |
| 2005/0030353 | A1 | 2/2005 | Ord et al. | |
| 2010/0194796 | A1 | 8/2010 | Hashi | |
| 2015/0138263 | A1 | 5/2015 | Suzuki | |

FOREIGN PATENT DOCUMENTS

| | | | |
|---|---|---|---|
| CN | 206030781 | U | 3/2017 |
| CN | 206520344 | U | 9/2017 |
| CN | 109068922 | A | 12/2018 |
| EP | 0863017 | A2 | 9/1998 |
| JP | 2003246079 | A | 9/2003 |

OTHER PUBLICATIONS

Indian Office Action and Examination Report from Indian Patent Application No. 202127008269, dated Jul. 26, 2022, 6 pages.

* cited by examiner

MANAGEMENT SYSTEM FOR THE INK IN A PRINTING MACHINE

The present invention relates to a management system for ink or enamel, in particular for an ink jet printer for the ceramics or glass industry.

Ink jet printers for the ceramics or glass industry or for other uses are equipped with a number of tanks, each of which is intended to contain an ink or a ceramic enamel of a given colour, or another liquid, for example a cleaning liquid. The tanks are connected to the print heads using the known circuits in the field.

Periodically, in relation to the intensity of use of the printers, it is necessary to refill the tanks with new ink or enamel or other liquid used in the ink jet printer.

Currently, the refilling of the tanks is carried out manually by operators who are equipped with suitable containers or mouths and introduce the ink refill via an inlet opening of the individual tanks.

The refilling operations are therefore relatively laborious, especially due to the need to intervene on the inlet openings of the tanks and wait for the time needed for the ink or enamel refill to be poured. Moreover, it is not uncommon for operators to incorrectly pour the ink, i.e. pour the ink into the wrong tank. This involves the need to stop the machine and perform a thorough cleaning cycle.

Furthermore, the enamel refill typically has a significantly lower temperature than that required by the machine. The machine must therefore see to heating the tank through suitable heating means until it reaches the correct temperature.

The object of the present invention is to offer a management system for the ink or enamel which allows the drawbacks summarised above to be overcome.

Characteristics and advantages of the present invention will more fully emerge from the following detailed description of an embodiment of the invention, as illustrated in a non-limiting example in the accompanying figures, in which.

The management system for the enamel according to the present invention comprises one or more tanks (2), each of which is equipped with hydraulic connections (21) for quick coupling and an inner layer of insulation.

Figure 1:
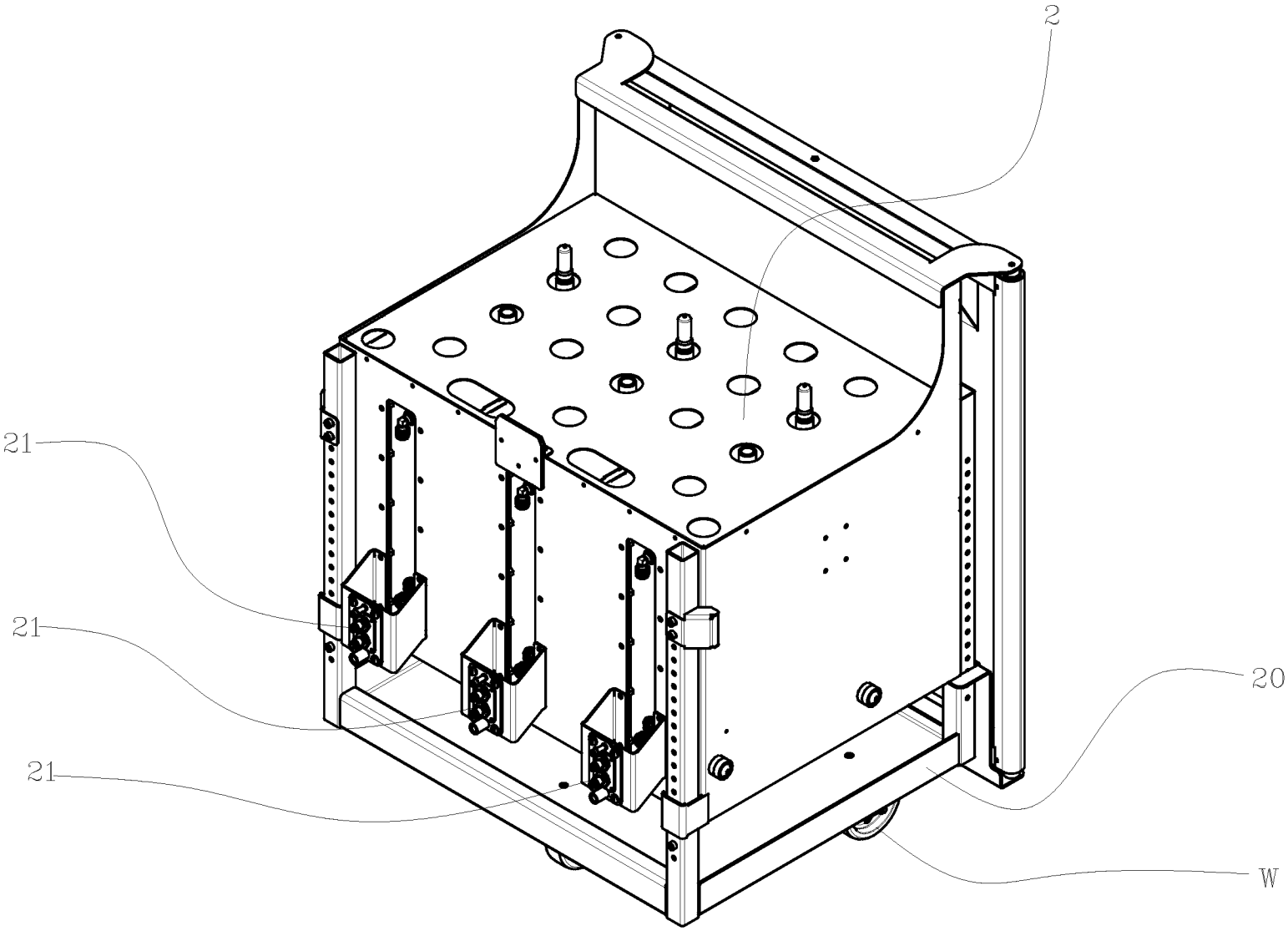
FIG. 1 shows an isometric view of a component of the system according to the present invention.
Figure 2:
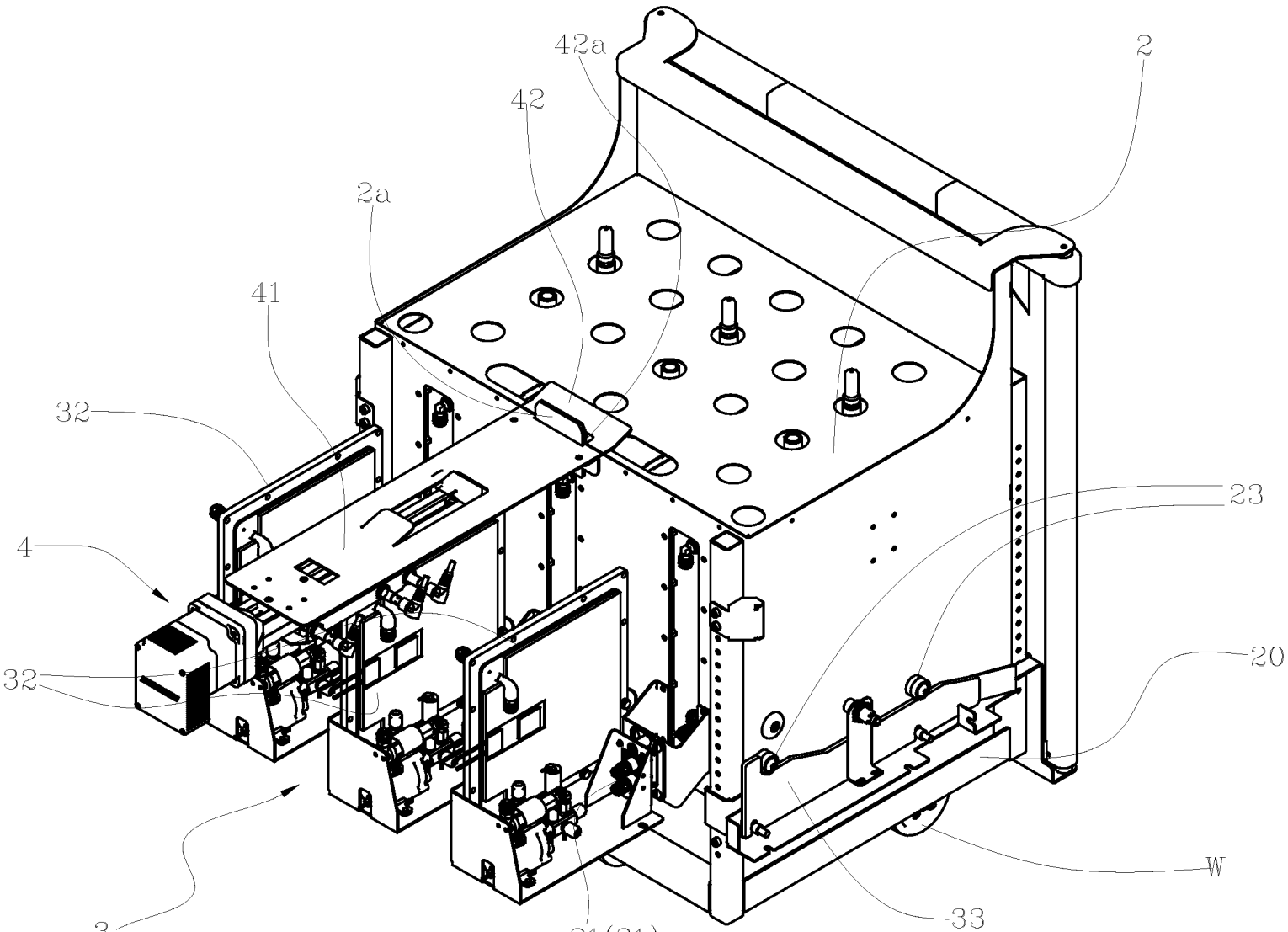
FIG. 2 shows the component of FIG. 1 coupled to a second component of the system.

A tank (2) is shown in FIGS. 1 and 2. Each tank (2) comprises an outer casing, inside which the layer of insulation is placed. The tank (2) can be divided internally into separate and sealed internal compartments, each of which is intended to contain a predetermined ink or other liquid substance. The layer of insulation is interposed between the outer casing of the tank (2) and the compartment or the internal compartments.

The hydraulic connections (21) are arranged to put the compartment or the internal compartments of the tank (2) in communication with corresponding hydraulic connections of a printing machine (M) or a refilling group (6). In the embodiment shown, the tank (2) comprises three internal compartments, each of which is provided with hydraulic connections (21). The tank (2) is therefore provided with three hydraulic connections (21).

Preferably, the hydraulic connections (21) are of the type for quick coupling. In particular, the hydraulic connections (21) can be coupled in corresponding hydraulic connections through a simple translational movement along an axis of insertion. Various types of hydraulic connections for quick coupling are available for the person skilled in the art, and will therefore not be described in further detail.

The tank (2) can be associated with a carriage (20). The carriage (20) is arranged for supporting and transporting a tank (2). To this end, the carriage (20) comprises a frame equipped with wheels (W) for resting on the ground. The wheels (W) are associated with the carriage (20) in such a way as to allow a rotation of the carriage (20) on the ground about a vertical axis, i.e. to allow guiding the carriage (20) along a curved path. For example, at least one of the wheels (W) is associated with the carriage (2) by means of a fork pivoting about a vertical axis.

Thanks to the carriages (20), the tanks (2) can be transported inside a plant or an industrial factory between various destinations. The carriages (20) can be manual, i.e. intended to be guided manually, or can be motorised and equipped with a device for self-guiding.

The system further comprises one or more docking stations (3), arranged to be placed in one or more printing machines (M).

Each docking station (3) comprises hydraulic connections (31) for quick coupling, intended to connect to the hydraulic connections (21) of the tanks (2). In essence, each docking station (3) is intended to receive a tank (2). The hydraulic connections (31) of the docking station (3) correspond in number and structure to the hydraulic connections (21) of the tanks (2). In the case shown, there are three hydraulic connections (31).

Figure 5:
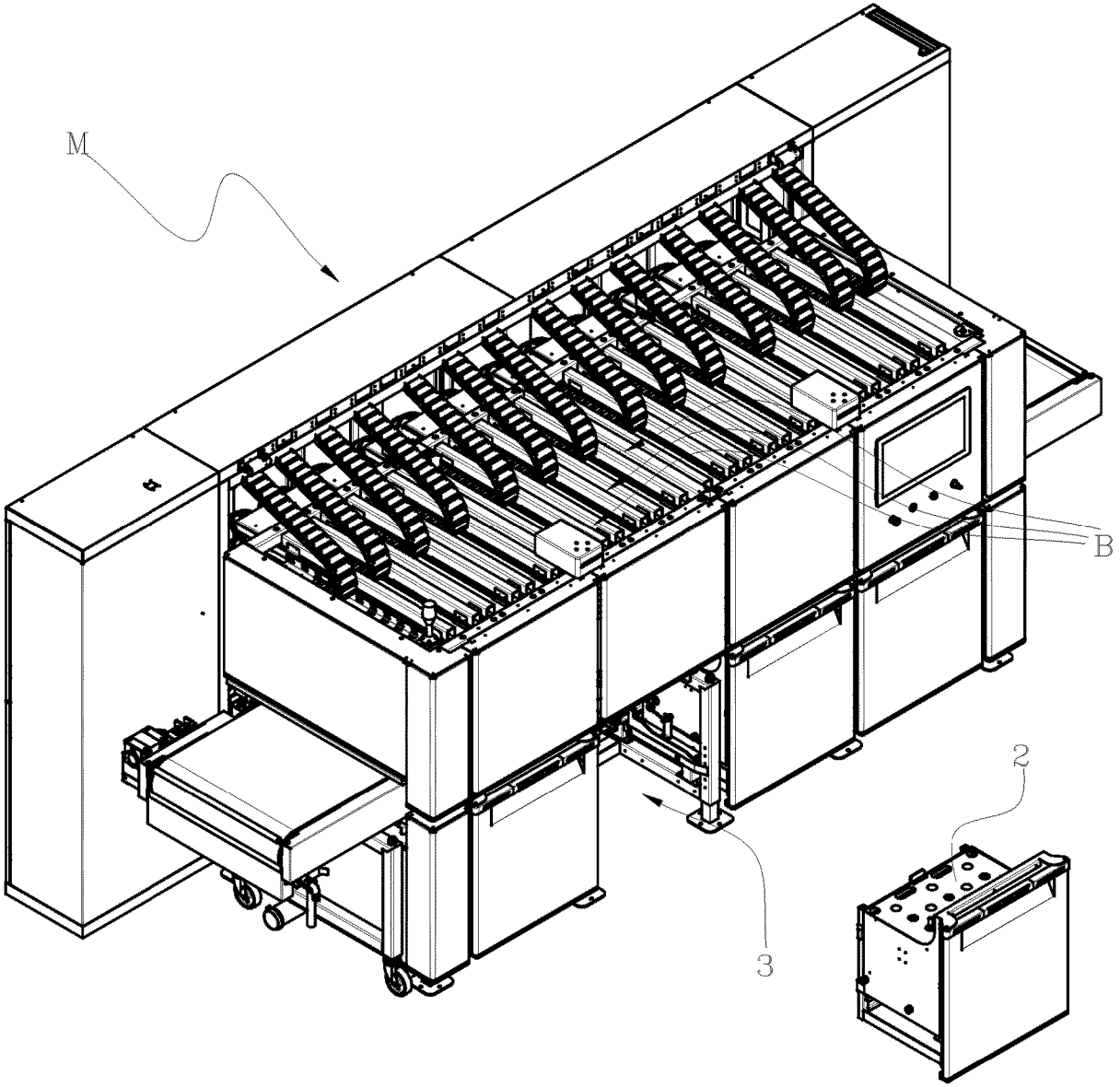
FIG. 5 shows a printing machine equipped with the system according to the present invention.
Figure 6:
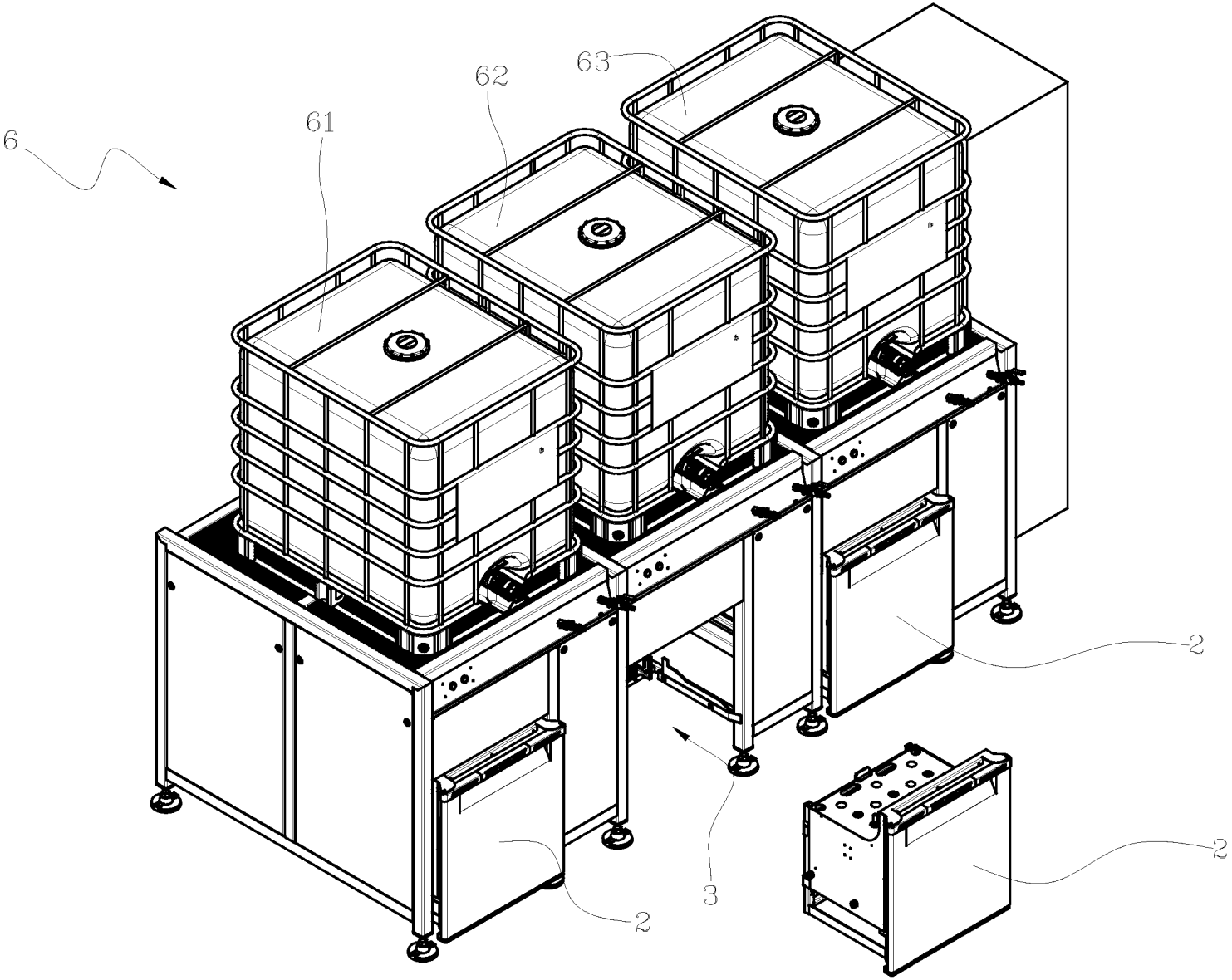
FIG. 6 shows a further component of the system according to the present invention.

As shown in FIG. 5, a printing machine (M) can comprise a predetermined number of docking stations (3). Each docking station (3) comprises a space inside which a tank (2) can be housed. In the example shown, the machine (M) comprises four docking stations (3). Each docking station (3) connects a respective tank (2) to three print bars (B) of the machine (M). In particular, inside a docking station (3) each compartment of the relative tank (2) is connected to a respective print bar (B) through the hydraulic connections (21,31). Each hydraulic connection (31) of each docking station (3) is connected to a supply circuit of a respective print bar (B).

During the operation of the printing machine, a tank (2) supplies the ink to the supply circuit of the respective print bars (B). When the tank (2) is empty, or in any case in a desired moment, it can be rapidly replaced with a full tank (2), thanks to the presence of the hydraulic connections (21,31) for quick coupling. Both the full tank (2) and the empty tank (2) can be transported by means of its own carriage (20).

Each docking station (3) can be equipped with motor means (4), arranged to transfer a tank (2) between a standby position and an operating position within the docking station, and to produce the coupling of the hydraulic connections (21,31).

In substance, the motor means (4) are configured to carry out at least two activities. A first activity is to load a tank (2) inside an empty docking station (3). Starting from the standby position of the tank (2), schematically shown in FIG. 3, the motor means (4) engage or withdraw the tank (2) and bring it into the operating position schematically shown in FIG. 2, inside the docking station (3), producing the coupling of the hydraulic connections (21,31).

A second activity of the motor means (4) is aimed at transferring a tank (2) from the docking station (3) to the standby position, outside the docking station (3), at which the tank (2) can be withdrawn and transferred elsewhere. In the second activity, the motor means (4) distance the tank (2) from the docking station (3), uncoupling the hydraulic connections (21,31).

In a possible embodiment, the motor means (4) comprise a slider (41), structured to hook a tank (2). The slider (41) is movable between an outer position, in which it can hook a tank (2) located in the standby position, and an inner position, in which it positions the tank (2) in the docking station (3), producing the coupling of the hydraulic connections (21,31). In moving from the inner position towards the outer position, the slider (41) produces the uncoupling of the hydraulic connections (21,31).

In a possible embodiment, the slider (41) comprises an arm, for example of a flattened shape, which has an end portion (42) equipped with a coupling element for the tank (2). This coupling element (42*a*) is, for example, in the form of a through opening. The tank (2), in turn, is provided with a hooking element (2*a*), in the form of a protruding projection shaped and arranged to be inserted into the opening (42*a*) of the slider (41). Preferably, the end portion (42) of the slider (41) is deflected upwards so that during the stroke from the inner position to the outer position, the slider (41) is inflected upwards, rising above the hooking element (2*a*) of the tank (2), up to the point in which the opening (42*a*) aligns with the hooking element (2*a*) of the tank (2) and is inserted on the latter, and the slider (41) returns to the initial configuration, lowering. In this condition, the slider (41), in the stroke towards its inner position, is capable of pulling the tank (2) in the operating position, inside the docking station (3).

The motor means (4) comprise alignment guides (33,23), structured to align the hydraulic connections (21,31) in the operating position of the tank (2). In substance, the alignment guides (33,23) are structured for positioning the tank (2) in the docking station (3) in such a way that the hydraulic connections (21,31) are mutually aligned along the coupling direction and can therefore couple correctly.

In the embodiment shown, the alignment guides (33,23) comprise a track (33), associated with the docking station (3), and one or more sliding elements (23), associated with the tank (2) so as to slide along the track (33) during the stroke of the tank (2) from the standby position to the operating position, and in the opposite stroke. The track (33) is associated with a side wall of the docking station (3). Moreover, the track (33) has a rising trend from the standby position towards the operating position of the tank (2), so that, moving from the standby position towards the operating position, the tank (2) is raised by a certain height that depends on the geometry of the track (33). Preferably, the alignment guides comprise a pair of tracks (33), associated with two opposite side walls of the docking station (3). The sliding elements (23) are for example in the form of rollers, and are arranged on opposite side walls of the tank (2).

The docking station (3) can be provided with a heater (32), to which the hydraulic connections (31) are associated. In turn, the heater (32) is connected to the supply circuit of a print bar (B). The heater (32) can be of the electric type, or it can be in the form of a heat exchanger inside which, in addition to the ink, a heat-vector fluid circulates. In any case, the heater (32) is a component known to the person skilled in the art and will therefore not be described in further detail.

The presence of the heater (32) allows precisely controlling and adjusting the temperature of the ink coming from the tank (2), so that the ink is supplied to the print heads at the expected and correct temperature.

In the embodiment shown, in which the tank (2) comprises three internal compartments each of which is equipped with hydraulic connections (21), the docking station (3) comprises three heaters (32), each of which is provided with hydraulic connections (31) to a respective print bar (B).

Figure 3:
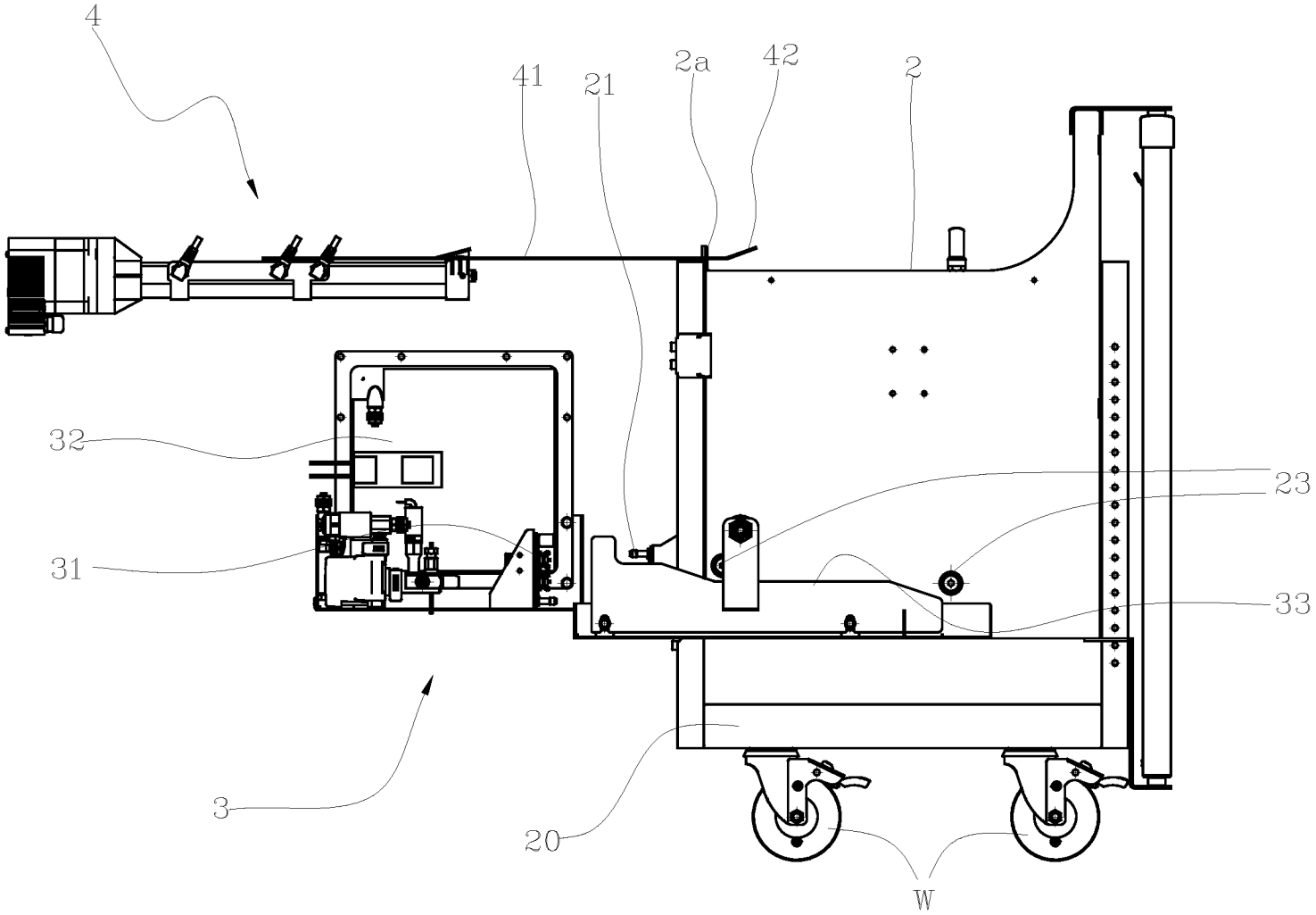
FIGS. 3 and 4 show different operating configurations of the components of FIG. 2.
Figure 4:
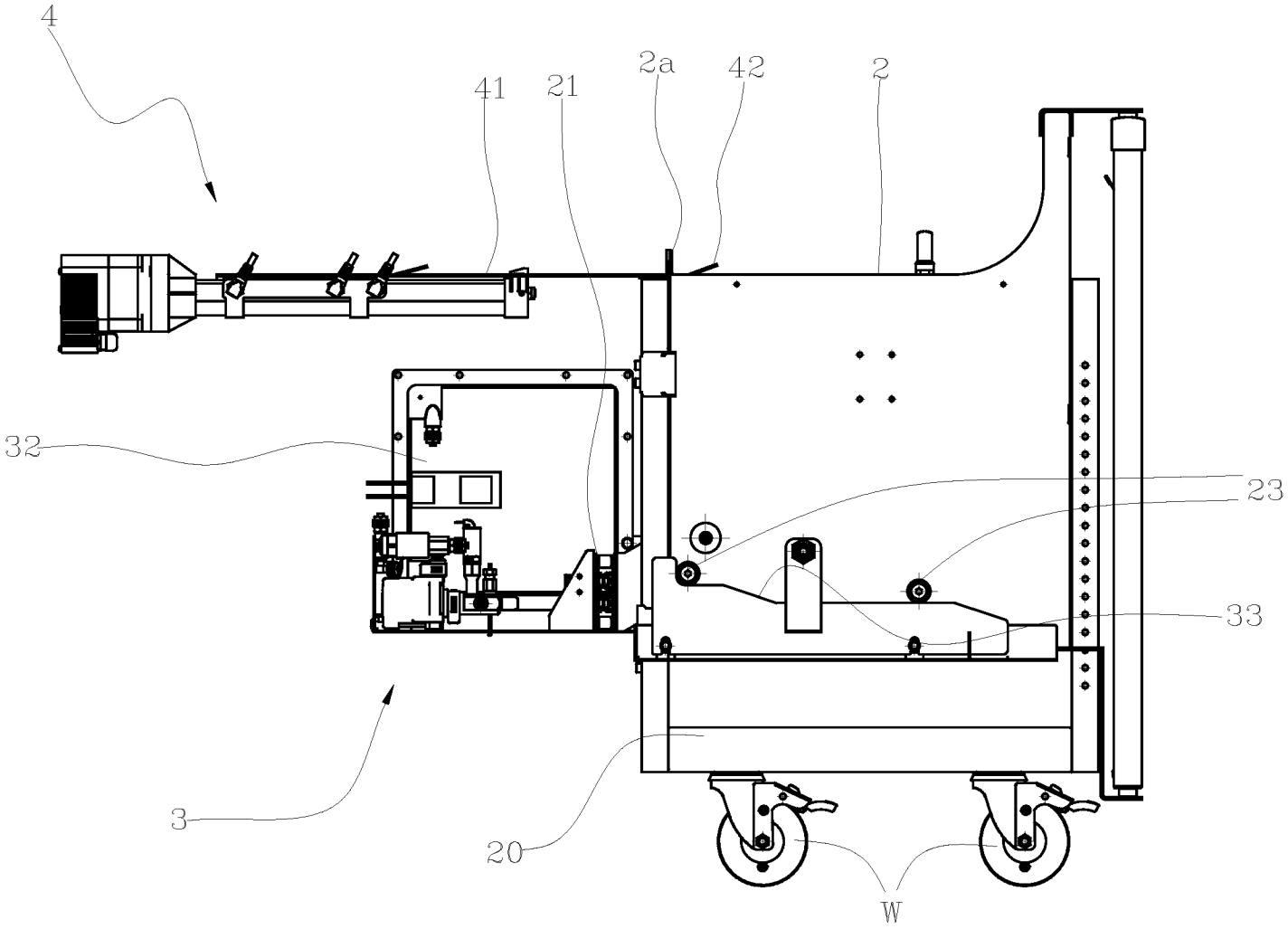

The motor means (4), the alignment guides (33), and the heater or heaters (32) are placed inside the space of the respective docking station (3). In FIGS. 2, 3 and 4, these components are shown outside of the space of the respective docking station (3) for greater visual clarity.

Advantageously, the system according to the present invention can be equipped with a recognition device, arranged to detect if a tank (2) is associated with an expected docking station (3). In other words, the recognition system is configured to recognise if a given tank (2), containing a certain enamel, ink or other liquid, is associated with a given docking station (3), for which the supply of the liquid contained in the tank (2) is expected.

The recognition device is further configured to activate the motor means (4), to transfer the tank (2) from the standby position to the operating position only if the tank (2) is associated with the expected docking station (3). In other words, if the recognition device detects that the tank (2) is intended for the docking station (3), then it allows the activation of the motor means (4) and the insertion of the tank (2).

In practice, when an operator leads a tank (2) to the standby position in front of a docking station (3), the recognition device identifies the tank (2), checking that the tank (2) is intended for that docking station (3), and only in the affirmative case does it allow the activation of the motor means (4) and the installation of the tank (2) in the docking station (3). Thanks to the presence of the recognition device, the possibility that a tank (2) containing a given ink or liquid is installed in an unexpected or incorrect docking station (3) is substantially null.

In a possible embodiment, the recognition system comprises an identification element for each tank (2), for example an "RFID tag", a QR code or a bar code, and a corresponding reader associated with each docking station (3). Each reader communicates with a computer whose memory contains the data related to each tank (2) and each docking station (3), in order to be able to compare the data sent by the reader of each docking station (3) and the data of the various tanks (2). The computer is also connected to the motor means (4) to control its operation.

In the embodiment shown, the printing machine (M) is equipped with the above-described computer and a reader for each docking station (3). The computer also controls the operation of the motor means (4) of each docking station (3). Before allowing the introduction of a tank (2) in a docking station (3), the computer, through the relative reader, checks that the tank (2) is the one expected for the docking station (3), and only in this case activates the motor means (4) to bring the tank (2) in the operating position.

The printing machine is further provided with means for controlling the level of the liquid inside the tank (2). These control means, for example, are pressure sensors for detecting the amount or level of ink present in each tank, or each compartment inside the tank (2).

When a tank (2) is empty or almost empty, or in the case of other needs, it is possible to activate the motor means (4) to remove the tank from its docking station (3).

The system according to the present invention can further comprise a refilling group (6), provided with one or more tanks (61,62,63) containing ink or other liquid to be supplied to the printing machines. In the embodiment shown, the refilling group comprises three tanks (61,62,63), each intended to fill one of the three internal compartments of the tanks (2).

The refilling group (6) comprises one or more docking stations (3), substantially the same as those described previously. Each docking station (3) is provided with motor means (4) substantially identical to those described above. Each docking station (3) is placed in communication, at its own hydraulic connections, with the tanks (61,62,63) of the refilling group (6). In the example shown, each docking station (3) of the refilling group (6) is connected to the three tanks at the three hydraulic connections (31) thereof, intended to couple in the hydraulic connections of the tanks (2). Each compartment of a tank (2) can therefore be connected with one of the tanks (61,62,63) of the refilling group (6)

In this way, each tank (2) can be filled at the refilling group (6), and then be subsequently led to the expected printing machine. The use of the recognition device, which can also be equipped with the refilling group (6), ensures that each tank (2) is correctly filled with the expected ink or other liquid.

The invention claimed is:

1. A management system for the ink in a printing machine, the management system comprises: one or more tanks (2), each of which is equipped with hydraulic connections (21) for quick coupling and an inner layer of insulation; a docking station (3), arranged to be placed in a printing machine, which comprises hydraulic connections (31) for quick coupling, intended to be connected to the hydraulic connections (21) of one or more tanks (2); motor means (4), associated with the docking station (3) and arranged to transfer a tank (2) between a standby position and an operating position within the docking station, and to produce the coupling of the hydraulic connections (21,31), wherein the motor means (4) comprise a slider (41), structured to hook a tank (2), wherein the slider (41) is movable between an outer position, in which it can hook a tank (2) located in the standby position, and an inner position, in which it positions the tank (2) in the docking station (3), producing the coupling of the hydraulic connections (21,31).

2. The system according to claim 1, wherein the docking station (3) comprises a heater (32), to which the hydraulic connections (31) are associated.

3. The system according to claim 1, wherein the motor means (4) comprise alignment guides (23,33), structured to align the hydraulic connections (21,31) in the operating position of the tank (2).

4. The system according to claim 3, wherein the alignment guides (23,33) comprise a track (33), associated with the docking station (3), and one or more sliding elements (23), associated with the tank (2) so as to slide along the track (33) during the travel of the tank (2) from the standby position to the operating position.

5. The system according to claim 1, comprising one or more carriages (20), each of which is adapted to support and transport a tank (2).

6. The system according to claim 1, comprising a recognition device, arranged to detect a tank (2) is associated with an expected docking station (3), and to activate the motor means (4) to transfer the tank (2) from the standby position to the operating position only the tank (2) is associated with the expected docking station (3).

7. The system according to claim 1, comprising a refilling group (6), provided with one or more tanks (61,62,63), which comprises one or more docking stations (3) according to any one of the preceding claims, each of which is provided with motor means (4) according to any one of the preceding claims.

8. A management system for the ink in a printing machine, the management system comprises: one or more tanks (2), each of which is equipped with hydraulic connections (21) for quick coupling and an inner layer of insulation; a docking station (3), arranged to be placed in a printing machine, which comprises hydraulic connections (31) for quick coupling, intended to be connected to the hydraulic connections (21) of one or more tanks (2); motor means (4), associated with the docking station (3) and arranged to transfer a tank (2) between a standby position and an operating position within the docking station, and to produce the coupling of the hydraulic connections (21,31), wherein the docking station (3) comprises a heater (32), to which the hydraulic connections (31) are associated.

9. A management system for the ink in a printing machine, the management system comprises: one or more tanks (2), each of which is equipped with hydraulic connections (21) for quick coupling and an inner layer of insulation; a docking station (3), arranged to be placed in a printing machine, which comprises hydraulic connections (31) for quick coupling, intended to be connected to the hydraulic connections (21) of one or more tanks (2); motor means (4), associated with the docking station (3) and arranged to transfer a tank (2) between a standby position and an operating position within the docking station, and to produce the coupling of the hydraulic connections (21,31), and a recognition device, arranged to detect a tank (2) is associated with an expected docking station (3), and to activate the motor means (4) to transfer the tank (2) from the standby position to the operating position only the tank (2) is associated with the expected docking station (3).

* * * * *